US009989908B2

(12) United States Patent
Kimura

(10) Patent No.: US 9,989,908 B2
(45) Date of Patent: Jun. 5, 2018

(54) IMAGE FORMATION SYSTEM, IMAGE DENSITY CORRECTION METHOD, AND IMAGE FORMATION APPARATUS

(71) Applicant: KONICA MINOLTA, INC., Chiyoda-ku, Tokyo (JP)

(72) Inventor: Takenobu Kimura, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 15/263,533

(22) Filed: Sep. 13, 2016

(65) Prior Publication Data

US 2017/0075272 A1 Mar. 16, 2017

(30) Foreign Application Priority Data

Sep. 16, 2015 (JP) ..... 2015-182898

(51) Int. Cl.
*G03G 15/00* (2006.01)
*G03G 21/20* (2006.01)
*G03G 15/23* (2006.01)

(52) U.S. Cl.
CPC ..... *G03G 15/5025* (2013.01); *G03G 15/238* (2013.01); *G03G 15/5062* (2013.01); *G03G 21/20* (2013.01); *G03G 2215/00021* (2013.01); *G03G 2215/00586* (2013.01)

(58) Field of Classification Search
CPC ..... G03G 2215/00021
See application file for complete search history.

(56) References Cited

U.S. PATENT DOCUMENTS

2012/0155907 A1* 6/2012 Tanaka ..... G03G 15/205 399/69
2015/0261130 A1* 9/2015 Kimura ..... G03G 15/0824 399/49

FOREIGN PATENT DOCUMENTS

JP 2003-140410 A 5/2003
JP 2013088659 A * 5/2013

OTHER PUBLICATIONS

Machine translation of Nishi (2013).*

* cited by examiner

*Primary Examiner* — Sevan A Aydin
(74) *Attorney, Agent, or Firm* — Buchanan Ingersoll & Rooney PC

(57) ABSTRACT

Provided is an image formation system of series tandem type in which first and second image formation apparatuses connected in series execute an image formation process on a recording material, wherein the first image formation apparatus includes: a first image carrier; a first toner image formation unit; a first density detection unit; a first density control value setting unit; and a first temperature detection unit, the second image formation apparatus includes: a second image carrier; a second toner image formation unit; a second density detection unit; a second density control value setting unit; and a second temperature detection unit, and the image formation system includes: a recording material density detection unit; and a control unit.

20 Claims, 7 Drawing Sheets

IMAGE FORMATION SYSTEM, IMAGE DENSITY CORRECTION METHOD, AND IMAGE FORMATION APPARATUS

The entire disclosure of Japanese Patent Application No. 2015-182898 filed on Sep. 16, 2015 including description, claims, drawings, and abstract are incorporated herein by reference in its entirety.

BACKGROUND OF THE INVENTION

Field of the Invention

The present invention relates to an image formation system, an image density correction method, and an image formation apparatus.

Description of the Related Art

There is a tandem-type image formation system (tandem machine) in which two image formation apparatuses such as printers or photocopiers forming images on paper sheets are connected in series, for example. In this kind of tandem machine, a process for forming images on the front and back sides of paper sheets is shared between different image formation apparatuses, for example, thereby to improve productivity as compared to the case of forming images on the front and back sides of paper sheets by one image formation apparatus. Of the two image formation apparatuses constituting the tandem machine, the image formation apparatus disposed on the upstream side in the paper sheet transport direction will also be abbreviated as "upstream machine," and the image formation apparatus disposed on the downstream side in the paper sheet transport direction will also be abbreviated as "downstream machine."

The image formation apparatus uses, as a developer, a toner (one-component developer) or a mixture of toner and carrier (two-component developer) to form a toner image on an image carrier (photoconductor drum), and outputs (transfers) the toner image to a paper sheet in contact with the image carrier at a transfer position. In the image formation apparatus using the two-component developer, the adhesion of the toner image formed on the image carrier increases with rises in in-machine temperature due to continuous printing, and the transfer efficiency is likely to be deteriorated to decrease the density of the toner image output to the paper sheet.

To correct the density decrease, there is known a technique by which a change in humidity and temperature is detected, and when the change exceeds a threshold, the density of a toner patch image after the transfer is measured and the measurement result is fed back to the correction of the density of the toner image (for example, JP 2003-140410 A).

In the foregoing tandem machine, plain paper sheets are continuously printed, the in-machine temperature of the upstream machine rises to a value of room temperature plus 8° C., for example, and the in-machine temperature of the downstream machine rises to a value of room temperature plus 18° C., for example, because the heat of the upstream machine is transferred to the downstream machine. That is, the in-machine temperature of the upstream machine and the in-machine temperature of the downstream machine are different in continuous printing.

When the in-machine temperature of the upstream machine and the in-machine temperature of the downstream machine are different in this manner, the adhesion of the toner image formed on the image carrier varies between the upstream machine and the downstream machine. Accordingly, when an image is formed on the front surface of a paper sheet by the upstream machine and an image is formed on the back surface of the paper sheet by the downstream machine, for example, a density difference occurs between the images. The density difference between the images leads to a density difference between two-facing pages of a bound printed material, for example.

The tandem machine further has a density detection sensor on the downstream side of the downstream machine to detect the density of an output image. However, to make density correction using the results of detection by the density detection sensor, it is necessary to print a density detection pattern on a paper sheet separately from a print job, thereby causing a problem of low productivity. In particular, many users of tandem machine suited for high-volume production place importance on productivity. Accordingly, productivity decline is more problematic than variations in the image density among different print jobs as far as the density difference between the images is stable.

SUMMARY OF THE INVENTION

An object of the present invention is to provide an image formation system, an image density correction method, and an image formation apparatus that make it possible to correct reduction in the density of a toner image due to temperature rises while suppressing productivity decline.

To achieve the abovementioned object, according to an aspect, there is provided an image formation system of series tandem type, reflecting one aspect of the present invention, in which first and second image formation apparatuses connected in series execute an image formation process on a recording material, wherein the first image formation apparatus includes:

a first image carrier;

a first toner image formation unit configured to form a first toner image on the first image carrier;

a first density detection unit configured to detect the density of the first toner image that is formed by the first toner image formation unit and is yet to be transferred to the recording material;

a first density control value setting unit configured to set a first density control value that is a set value of a parameter for use in density control of the first toner image based on the result of detection by the first density detection unit; and a first temperature detection unit configured to detect the internal temperature of the first image formation apparatus as first temperature, the second image formation apparatus includes:

a second image carrier;

a second toner image formation unit configured to form a second toner image on the second image carrier;

a second density detection unit configured to detect the density of the second toner image that is formed by the second toner image formation unit and is yet to be transferred to the recording material;

a second density control value setting unit configured to set a second density control value that is a set value of a parameter for use in density control of the second toner image based on the result of detection by the second density detection unit; and a second temperature detection unit configured to detect the internal temperature of the second image formation apparatus as second temperature, and the image formation system comprises:

a recording material density detection unit configured to detect the density of the first toner image or the second toner image formed on the recording material; and a control unit configured to execute a density correction control to change at least one of the first and second density control values based on the result of detection by the recording material density detection unit, and decide the next execution timing for the density correction control based on a change in the first temperature and a change in the second temperature since the execution of the density correction control.

To achieve the abovementioned object, according to an aspect, an image density correction method of series tandem type by which first and second image formation apparatuses connected in series execute an image formation process on a recording material, reflecting one aspect of the present invention comprises:

forming a first toner image on a first image carrier based on a first density control value;

forming a second toner image on a second image carrier based on a second density control value;

detecting the density of a toner image formed on the recording material;

detecting the internal temperature of the first image formation apparatus as first temperature, detecting the internal temperature of the second image formation apparatus as second temperature, and executing a density correction control to change at least one of the first and second density control values based on the result of detection of the densities of the toner images, and deciding the next execution timing for the density correction control based on a change in the first temperature and a change in the second temperature since the execution of the density correction control.

To achieve the abovementioned object, according to an aspect, there is provided an image formation apparatus, reflecting one aspect of the present invention, in which first and second image formation units connected in series execute an image formation process on a recording material, wherein the first image formation unit includes:

a first image carrier;

a first toner image formation unit configured to form a first toner image on the first image carrier;

a first density detection unit configured to detect the density of the first toner image that is formed by the first toner image formation unit and is yet to be transferred to the recording material;

a first density control value setting unit configured to set a first density control value that is a set value of a parameter for use in density control of the first toner image based on the result of detection by the first density detection unit; and a first temperature detection unit configured to detect the temperature around the first image formation unit as first temperature, the second image formation unit includes:

a second image carrier;

a second toner image formation unit configured to form a second toner image on the second image carrier;

a second density detection unit configured to detect the density of the second toner image that is formed by the second toner image formation unit and is yet to be transferred to the recording material;

a second density control value setting unit configured to set a second density control value that is a set value of a parameter for use in density control of the second toner image based on the result of detection by the second density detection unit; and a second temperature detection unit configured to detect the temperature around the second image formation unit as second temperature, and the image formation apparatus comprises:

a recording material density detection unit configured to detect the density of the first toner image or the second toner image formed on the recording material; and a control unit configured to execute a density correction control to change at least one of the first and second density control values based on the result of detection by the recording material density detection unit, and decide the next execution timing for the density correction control based on a change in the first temperature and a change in the second temperature since the execution of the density correction control.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, a mode for carrying out the present invention (hereinafter, referred to as "embodiment") will be described in detail with reference to the drawings. However, the scope of the invention is not limited to the illustrated examples. Various numeric values in the embodiment are examples. In the following explanation and the drawings, identical elements or elements having identical functions will be given identical reference signs, and duplicate descriptions will be omitted.

[Entire Configuration of an Image Formation System]

Figure 1:
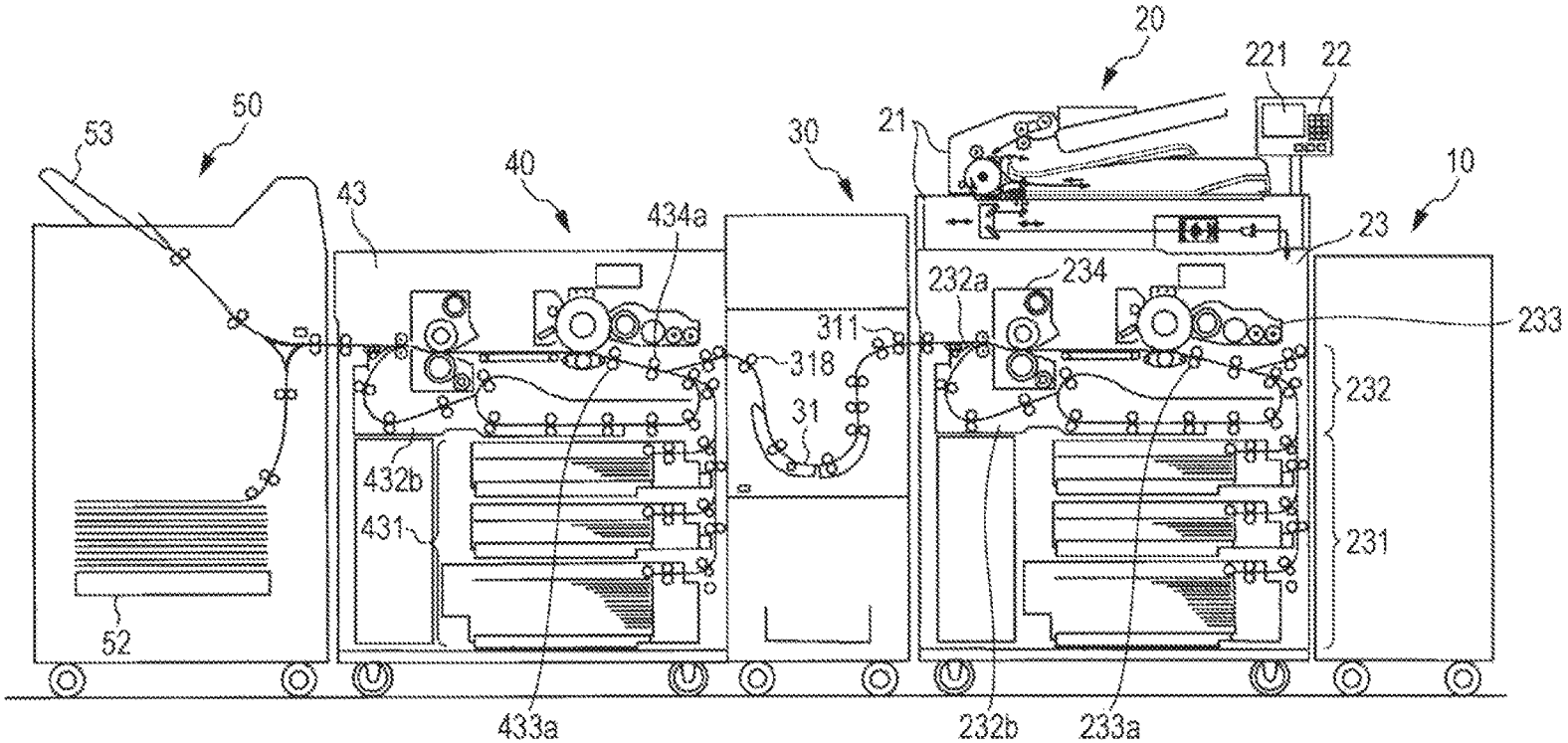
FIG. 1 is a schematic view of an entire configuration of an image formation system according to an embodiment of the present invention.

First, an overview of an image formation system according to an embodiment of the present invention will be provided with reference to FIG. 1. FIG. 1 is a schematic view of an entire configuration of the image formation system according to the embodiment of the present invention. As illustrated in FIG. 1, an image formation system 1 has a plurality of image formation apparatuses, for example, a first image formation apparatus 20 and a second image formation apparatus 40, and is configured in a serial tandem form in which a paper feed apparatus 10, the first image formation apparatus 20, an intermediate apparatus 30, the second image formation apparatus 40, and a post-processing apparatus 50 are connected in series.

Before being connected, the first image formation apparatus 20 and the second image formation apparatus 40 are set to a main machine that controls comprehensively the image formation system 1 or a sub machine that operates according to an instruction from the main machine. In the embodiment, the first image formation apparatus 20 provided on the upstream side in the paper sheet conveyance direction is set as main machine, and the second image formation apparatus 40 is set as sub machine.

In the image formation system 1 of the embodiment, when a job is executed in a double-side mode in which images are formed on the both front and back surfaces of a paper sheet, the first image formation apparatus 20 serves as an apparatus that forms an image on one surface (for example, the front surface) of the paper sheet, and the second image formation apparatus 40 serves as an apparatus that forms an image on the other surface (for example, the back surface) of the paper sheet. In the case of executing the job in the double-side mode, the first image formation apparatus 20 forms an image for the front surface on the paper sheet conveyed from the paper feed apparatus 10 or a paper feed unit in the first image formation apparatus 20. Then, the paper sheet with the image formed on the front surface is reversed by a reverse unit in the first image formation apparatus 20 and conveyed to the second image formation apparatus 40 through the intermediate apparatus 30. Then, an image is formed on the back surface of the paper sheet, and the paper sheet is conveyed to the post-processing apparatus 50.

In the case of executing a job in a single-side mode in which an image is formed on one surface of a paper sheet, the first image formation apparatus 20 forms an image on one surface of the paper sheet conveyed from the paper feed apparatus 10 or the paper feed unit in the first image formation apparatus 20. Then, the paper sheet with the image formed on the one surface is conveyed to the post-processing apparatus 50 through the intermediate apparatus 30 and the second image formation apparatus 40.

(Paper Feed Apparatus)

The paper feed apparatus 10 is called PFU (paper feed unit) and includes a paper feed means composed of a plurality of paper feed trays, a paper feed roller, a separation roller, a paper feed/separation rubber, a delivery roller, and others. Each of the paper feed trays houses paper sheets identified by the kind of paper (paper type, basis weight, paper size, and the like), and feeds the paper sheets one by one from the top by the paper feed means to the paper conveyance unit of the first image formation apparatus 20. The information on the kind of paper sheets (paper size, paper type, and the like) housed in the paper feed trays is stored in a non-volatile memory 251 described later of the first image formation apparatus 20. The paper feed apparatus 10 serves as paper feed unit of the first image formation apparatus 20.

(First Image Formation Apparatus)

The first image formation apparatus 20 reads an image from a document, and forms the read image on a paper sheet. In addition, the first image formation apparatus 20 receives print data and print setting data in a page description language such as PDL (page description language) or Tiff from an external device, and forms an image based on the received print data and print setting data on the paper sheet. The first image formation apparatus 20 includes an image read unit 21, an operation display unit 22, a print unit 23 (corresponding to a first toner image formation unit of the present invention), and others.

The image read unit 21 includes an auto document feed unit called ADF (auto document feeder) and a read unit, and reads a plurality of document images based on the setting information received by the operation display unit 22. The document placed on a document tray of the auto feed unit is conveyed to a contact glass as a reading site, and an optical system including a CCD (charge coupled device) 211 (see FIG. 2) reads the images on a single or both sides of the document. The images include image data on graphics, photographs, and others, and text data such as characters, symbols, and others.

The operation display unit 22 includes an LCD (liquid crystal display) 221, a touch panel covering an LCD 221, various switches and buttons, a numeric key pad, operation key groups, and others. The operation display unit 22 accepts an instruction from the user and outputs an operation signal to a control unit 250 described later. The operation display unit 22 also displays on the LCD 221 various setting screens for inputting various operational instructions and setting information and operation screens for displaying various processing results and others according to a display signal input from the control unit 250.

The print unit 23 is intended to perform an image formation process in an electrophotographic form, and includes various units related to print output such as a paper feed unit 231, a paper conveyance unit 232, an image formation unit 233, and a fixing unit 234.

The paper feed unit 231 includes a plurality of paper feed trays, a paper feed means composed of a paper feed roller, a separation roller, a paper feed/separation rubber, a delivery roller, and the like, provided for each of the paper feed trays. Each of the paper feed trays houses paper sheets identified by the kind of paper (paper type, basis weight, paper size, and the like), and feeds the paper sheets one by one from the top by the paper feed means to the paper conveyance unit of the first image formation apparatus 20. The information on the kind of paper sheets (paper size, paper type, and the like) housed in the paper feed trays is stored in the non-volatile memory 251 (see FIG. 2).

The paper conveyance unit 232 conveys the paper sheet fed from the paper feed apparatus 10 or the paper feed unit 231 into a paper conveyance path to the image formation unit 233 through the plurality of intermediate rollers, registration rollers, and others. The paper conveyance unit 232 conveys the paper sheet to the transfer position in the image formation unit 233, and further conveys the paper sheet to the second image formation apparatus 40. The paper sheet is temporarily stopped on the upstream side of a registration roller 233*a* for skew correction, and then is conveyed again to the downstream side of the registration roller 233*a*.

The paper conveyance unit 232 also includes a conveyance path switch unit 232*a* and a reverse unit 232*b* composed of a reverse roller and the like. The reverse unit 232*b* conveys the paper sheet having passed through the fixing unit 234 without reverse to a device connected on the downstream side, or reverses the paper sheet through switchback by the reverse roller or the like and then conveys the paper sheet to the device connected on the downstream side, depending on a switch operation by the conveyance path switch unit 232*a*. The reverse unit 232*b* may include a circulation path unit that reverses the paper sheet having passed through the fixing unit 234 and feeds the paper sheet again to the image formation unit 233 of the first image formation apparatus 20.

The image formation unit 233 includes a photoconductive drum, a charging device, an exposure device, a development device, a transfer device, a cleaning device, and the like, and forms an image (toner image) on the paper sheet based on the print image data. When the first image formation apparatus 20 is configured to form a color image, the image formation unit 233 is provided for respective colors (Y, M, C, and Bk).

At the image formation unit 233, the exposure device emits light according to the print image data onto the surface of the photoconductive drum charged by the charging device so that an electrostatic latent image is written onto the surface of the photoconductive drum. Then, the toner charged by a two-component development device using a two-component developer is adhered to the surface of the photoconductive drum, thereby developing the electrostatic latent image written on the surface of the photoconductive drum. The toner image on the photoconductive drum is transferred to the paper sheet at the transfer position. After the transfer of the toner image to the paper sheet, the cleaning device removes residual charge, residual toner, and the like from the surface of the photoconductive drum, and the removed toner and the like are collected into a toner collection container.

The fixing unit 234 is composed of a fixing heater, a fixing roller, a fixing external heating means, and the like, and fixes the transferred toner image on the paper.

(Intermediate Apparatus)

The intermediate apparatus 30 is installed on the downstream side of the first image formation apparatus 20 and the upstream side of the second image formation apparatus 40 in the paper sheet conveyance direction. In this embodiment, the intermediate apparatus 30 conveys the paper sheet conveyed from the first image formation apparatus 20 to the second image formation apparatus 40 according to an instruction from the second image formation apparatus 40.

The length of a paper sheet conveyance path 31 of the intermediate apparatus 30 is set such that, when the intermediate apparatus 30 or the second image formation apparatus 40 provides an instruction for stopping the conveyance of the paper sheet in the paper sheet conveyance path 31, the back edge of the paper sheet does not sit over the first image formation apparatus 20. When seen from the front side of the intermediate apparatus 30, the paper sheet conveyance path 31 is bent from the position near the conveyance roller 311 on the paper entry side to the position near the conveyance roller 318 on the paper exit side. In the embodiment, the bent in the paper sheet conveyance path 31 has an approximately downward U shape. By bending the paper sheet conveyance path 31, the length of the paper sheet conveyance path 31 can be ensured even in the limited space. In other words, by bending the paper sheet conveyance path 31, the intermediate apparatus 30 can be made small in size while ensuring the length of the paper sheet conveyance path 31.

The necessary length of the paper sheet conveyance path 31 is as follows as an example.

First, when a paper stop position is to be set in the middle of the paper sheet conveyance path of the second image formation apparatus 40, the length of the paper sheet conveyance path 31 is determined such that, with respect to the front end of the paper sheet stopped within the second image formation apparatus 40, the back edge of the paper sheet falls within the intermediate apparatus 30.

Secondly, when the paper stop position is to be set in the middle of the paper sheet conveyance path 31 of the intermediate apparatus 30, the length of the paper sheet conveyance path 31 is determined such that, with respect to the front edge of the paper sheet stopped within the intermediate apparatus 30, the back edge of the paper sheet falls within the intermediate apparatus 30.

(Second Image Formation Apparatus)

The second image formation apparatus 40 includes a print unit 43 (corresponding to a second toner image formation unit in the present invention), and forms an image on the paper sheet in cooperation with the first image formation apparatus 20. The paper sheet conveyed from the first image formation apparatus 20 is then conveyed to a registration roller 433*a* through a conveyance roller 434*a*. The paper sheet is temporarily stopped on the upstream side of the registration roller 433*a*, and then is conveyed again to the downstream side of the registration roller 433*a* according to the image formation timing.

The print unit 43 included in the second image formation apparatus 40 is composed of components related to print output such as a paper feed unit 431, a paper conveyance path having a reverse unit 432*b*, an image formation unit, a fixing unit, and others, as the print unit 23 included in the first image formation apparatus 20. Duplicate explanations will be omitted.

(Post-Processing Apparatus)

The post-processing apparatus 50 is installed on the downstream side of the second image formation apparatus 40 in the paper sheet conveyance direction, and includes various post-processing units such as a sort unit, a stapler unit, and a punch unit, and paper sheet ejection trays (a large-capacity paper sheet ejection tray 52 and a sub tray 53). The post-processing apparatus 50 performs various post-processing operations on the paper sheet conveyed from the second image formation apparatus 40, and ejects the post-processed paper sheet to the large-capacity paper sheet ejection tray 52 or the sub tray 53. The large-capacity paper sheet ejection tray 52 has a raising and lowering stage and houses a large amount of paper sheets stacked on the stage. The paper sheet ejected to the sub tray 53 is exposed to the outside in a visible state.

[Internal Configuration of the First Image Formation Apparatus 20]

Figure 2:
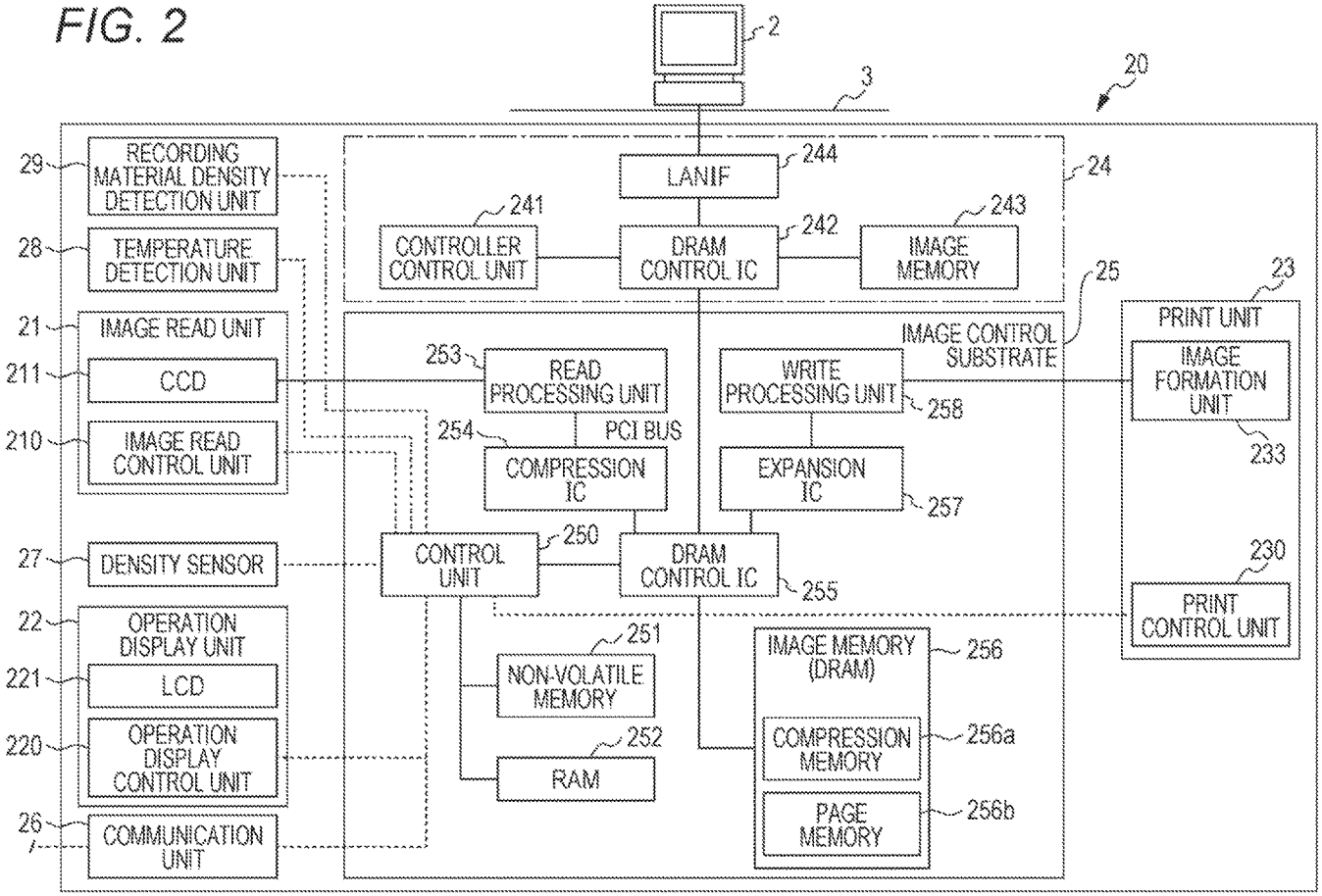
FIG. 2 is a block diagram of an internal configuration of a first image formation apparatus in the image formation system according to the embodiment.

FIG. 2 is a block diagram of an internal configuration of the first image formation apparatus 20 in the image formation system 1 according to the embodiment. As illustrated in FIG. 2, the first image formation apparatus 20 includes an image read unit 21, an operation display unit 22, a print unit 23, a controller 24, an image control substrate 25, a communication unit 26, a density sensor 27 (corresponding to a first density detection unit in the present invention), a temperature detection unit 28 (corresponding to a first temperature detection unit in the present invention), a recording material density detection unit 29 (corresponding to a first recording material density detection unit in the present invention), and others. The first image formation apparatus 20 is connected to an external device 2 on a network 3 in a manner capable of exchanging data via a LANIF (local area network interface) 244 of the controller 24.

The image read unit 21 includes the auto document feed unit and the read unit described above, and an image read control unit 210. The image read control unit 210 controls the auto document feed unit, the read unit, and the like according to an instruction from the control unit 250, thereby to implement the function of a scanner to read images from a plurality of documents. The analog image data read by the image read unit 21 is output to a read processing unit 253. The read processing unit 253 subjects the image data to A/D conversion and performs various image processing operations on the converted image data.

The operation display unit 22 includes the LCD 221, the touch panel, and the like described above, and an operation display control unit 220. The operation display control unit 220 displays on the LCD 221 various screens for inputting various setting conditions and operation screens for displaying various processing results and the like, according to a display signal input from the control unit 250. The operation display control unit 220 also outputs an operation signal input from various switches and buttons, a numeric key pad, or a touch panel to the control unit 250.

The print unit 23 includes the components related to print output such as the paper feed unit 231, the paper conveyance unit 232, the image formation unit 233, and the fixing unit 234 (see FIG. 1) described above, and a print control unit 230. The print control unit 230 controls the operations of the components of the print unit 23 such as the image formation unit 233 according to an instruction from the control unit 250 to perform image formation based on the print image data input from a write processing unit 258.

The controller 24 manages and controls data input from the external device 2 connected to the network 3 to the image formation system 1. The controller 24 receives data to be printed (print data and print setting data) from the external device 2, and transmits image data generated by developing the print data and the print setting data to the image control substrate 25.

The controller 24 is composed of a controller control unit 241, a DRAM (dynamic random access memory) control IC 242, an image memory 243, a LANIF 244, and others. The controller control unit 241 controls comprehensively the operations of the components of the controller 24, and develops the print data input from the external device 2 via the LANIF 244 to generate image data in a bit-map format.

The DRAM control IC 242 controls transfer of the print data received by the LANIF 244 to the controller control unit 241 and reading/writing of image data into/from the image memory 243. The DRAM control IC 242 is also connected to a DRAM control IC 255 of the image control substrate 25 via a PCI (peripheral components interconnect) bus. The DRAM control IC 242 reads the image data to be printed and the print setting data from the image memory 243 and outputs the same to the DRAM control IC 255, according to an instruction from the controller control unit 241.

The image memory 243 is composed of a volatile memory such as a DRAM and stores temporarily the image data and the print setting data.

The LANIF 244 is a communication interface such as an NIC (network interface card) or a modem for connection to the network 3 such as a LAN, and receives the print data and the print setting data from the external device 2. The LANIF 244 outputs the received print data and print setting data to the DRAM control IC 242.

The image control substrate 25 includes the control unit 250, a non-volatile memory 251, a RAM (random access memory) 252, a read processing unit 253, a compression IC 254, the DRAM control IC 255, an image memory 256, an expansion IC 257, a write processing unit 258, and the like.

The control unit 250 reads a specified one of a system program and various application programs stored in the non-volatile memory 251 composed of a CPU (central processing unit) and develops the same in the RAM 252. Then, the control unit 250 executes various processing operations to control intensively the respective components of the first image formation apparatus 20 in conjunction with the program developed in the RAM 252

Since the first image formation apparatus 20 is set as main machine, the control unit 250 receives signals indicative of the respective states of the apparatuses constituting the image formation system 1 from the devices via the communication unit 26. The control unit 250 then controls comprehensively the entire image formation system 1 based on the signals indicative of the states of the devices. For example, upon receipt of a signal indicative of an error in the second image formation apparatus 40 (jamming, out of paper, lack of toner, or the like), the control unit 250 generates a display signal and an operation instructive signal according to the error, and transmits the generated signal to the operation display unit 22, the second image formation apparatus 40, and the like.

The control unit 250 generates job data and compressed image data based on the image data and the print setting data input from the external device 2 via the controller 24, or the image data input from the image read unit 21 and the setting information set by the operation display control unit 220. Then, the control unit 250 executes the job in cooperation with the second image formation apparatus 40 based on the generated job data and compressed image data.

The job refers to a series of operations related to image formation. For example, to create a copy of predetermined pages of documents, one job constitutes a series of operations related to formation of images of the predetermined pages of documents. Data for executing the operations of the job is job data. The job data includes job information and page information. The job information is common among all the pages. For example, the job information includes the set number of prints of the job, the paper sheet ejection tray, applied functions (consolidation, repeat, and the like), color/monochrome, and others.

The page information is associated with compressed image data for each page, and is information about the associated image data. For example, the page information includes page number, image size (vertical and lateral), image orientation, image width, the rotation angle of image, the kind of paper sheets for image formation, the paper feed tray housing the paper, the print mode (double-side mode/single-side mode), the storage address of compressed image data, and others.

The non-volatile memory 251 stores various processing programs and various kinds of data related to image formation. The non-volatile memory 251 also stores information on the kinds of paper sheets housed in the paper feed trays included in the paper feed apparatus 10, the paper feed unit of the first image formation apparatus 20, and the paper feed unit of the second image formation apparatus 40.

The RAM 252 forms a work area that stores temporarily various programs executed by the control unit 250 and various kinds of data related to the programs. The RAM 252 stores temporarily the job data generated by the control unit 250 based on the image data and the print setting data input from the controller 24 or the image data input from the image read unit 21 and the setting information set by the operation display unit 22 at the time of acquisition of the image data.

The read processing unit 253 performs various processing operations such as analog processing, A/D change processing, and shading processing on the analog image data input from the image read unit 21, and then generates digital image data. The generated image data is output to the compression IC 254.

The compression IC 254 compresses the input digital image data and outputs the same to the DRAM control IC 255.

The DRAM control IC 255 controls the compression of the image data by the compression IC 254 and the expansion of the compressed image data by the expansion IC 257 and controls input of image data to the image memory 256, according to an instruction from the control unit 250.

For example, upon receipt of an instruction for saving the image data read by the image read unit 21 from the control unit 250, the DRAM control IC 255 causes the compression IC 254 to compress the image data input into the read processing unit 253 and store the compressed image data in a compression memory 256*a* of the image memory 256. In addition, upon receipt of image data from the DRAM control IC 242 of the controller 24, the DRAM control IC 255 causes the compression IC 254 to compress the image data and store the compressed image data in the compression memory 256*a* of the image memory 256.

Further, upon receipt of an instruction for outputting print of the compressed image data stored in the compression memory 256*a* from the control unit 250, the DRAM control IC 255 reads the compressed image data from the compression memory 256*a*, causes the expansion IC 257 to expand the read image data, and stores the same in a page memory 256*b*. Moreover, upon receipt of an instruction for outputting print of the image data stored in the page memory 256*b*, the DRAM control IC 255 reads the image data from the page memory 256*b* and outputs the same to the write processing unit 258.

The image memory 256 includes the compression memory 256*a* and the page memory 256*b* composed of DRAMs (dynamic RAMs). The compression memory 256*a* is a memory for storing the compressed image data. The page memory 256*b* is a memory for storing temporarily the image data for print output or storing temporarily the image data received from the controller before compression.

The expansion IC 257 expands the compressed image data.

The write processing unit 258 generates print image data for image formation based on the image data input from the DRAM control IC 255, and outputs the same to the print unit 23.

The communication unit 26 is a communication interface for connection to a network to which the respective apparatuses constituting the image formation system 1 are connected. For example, the communication unit 26 performs communications with the second image formation apparatus 40 using a NIC (network interface card) or the like, and performs serial communications with the paper feed apparatus 10 and the intermediate apparatus 30.

The density sensor 27 detects the density of a toner image (image density) formed on the photoconductive drum (first image carrier). The density sensor 27 has a light emission unit that emits light to the photoconductive drum and a light reception unit that receives reflection light from the photoconductive drum based on the emitted light, and supplies the detected density information to the control unit 250. The control unit 250 sets a first density control value as a set value of a parameter for use in density control of the toner image formed on the photoconductive drum. When supplied with the density information from the density sensor 27, the control unit 250 performs a density correction control to change the first density control value based on the density information. The details of the density correction control will be provided later.

The temperature detection unit 28 is arranged near the photoconductive drum and detects the in-machine temperature (corresponding to "first temperature" in the present invention) of the first image formation apparatus 20. The temperature detection unit 28 outputs the detected in-machine temperature to the control unit 250. The control unit 250 acquires the in-machine temperature from the temperature detection unit 28 for each print or at a specific cycle (for example, each five minutes).

The control unit 250 stores the acquired in-machine temperatures in the RAM 252.

To store the in-machine temperature in the RAM 252, when no in-machine temperature is previously stored in the RAM 252, the control unit 250 stores the in-machine temperature as in-machine temperature T1, and when any in-machine temperature is already stored in the RAM 252, the control unit 250 stores the in-machine temperature as in-machine temperature T1'. In addition, the control unit 250 calculates a change amount Δ1 (=T1'−T1) of in-machine temperature of the first image formation apparatus 20 based on the in-machine temperatures T1 and T1'.

When a difference Δ between the change amount Δ1 and a change amount Δ2 of in-machine temperature of the second image formation apparatus 40 described later exceeds a predetermined threshold, the control unit 250 performs a density correction control. When performing the density correction control, the control unit 250 replaces the value of the in-machine temperature T1 with the value of the in-machine temperature T1', and erases the in-machine temperature T1' from the RAM 252.

The recording material density detection unit 29 detects the density of the toner image transferred (output) to the paper sheet by the image formation unit 233. The recording material density detection unit 29 can be provided in any place of the tandem machine where the recording material density detection unit 29 can detect the density of the toner image output from the image formation unit 233. The place of the recording material density detection unit 29 may not be necessarily in the first image formation apparatus 20 but may be in the intermediate apparatus 30, the second image formation apparatus 40, or the post-processing apparatus 50, for example. In addition, one recording material density detection unit including both the function of the recording material density detection unit 29 and the function of a recording material density detection unit 49 described later may be provided in the same place, for example, in the post-processing apparatus 50. The density correction control performed based on the density of the toner image detected by the recording material density detection unit 29 will be explained below. The recording material density detection unit 29 may detect the density of a toner patch image transferred to the paper sheet, and the density correction control may be performed based on the density of the toner patch image detected by the recording material density detection unit 29.

At the start-up of the system (power-on) and at the execution of the density correction control, the recording material density detection unit 29 outputs the detected density of the toner image to the control unit 250. The control unit 250 stores in the RAM 252 the density of the toner image input from the recording material density detection unit 29.

[Internal Configuration of the Second Image Formation Apparatus 40]

Figure 3:
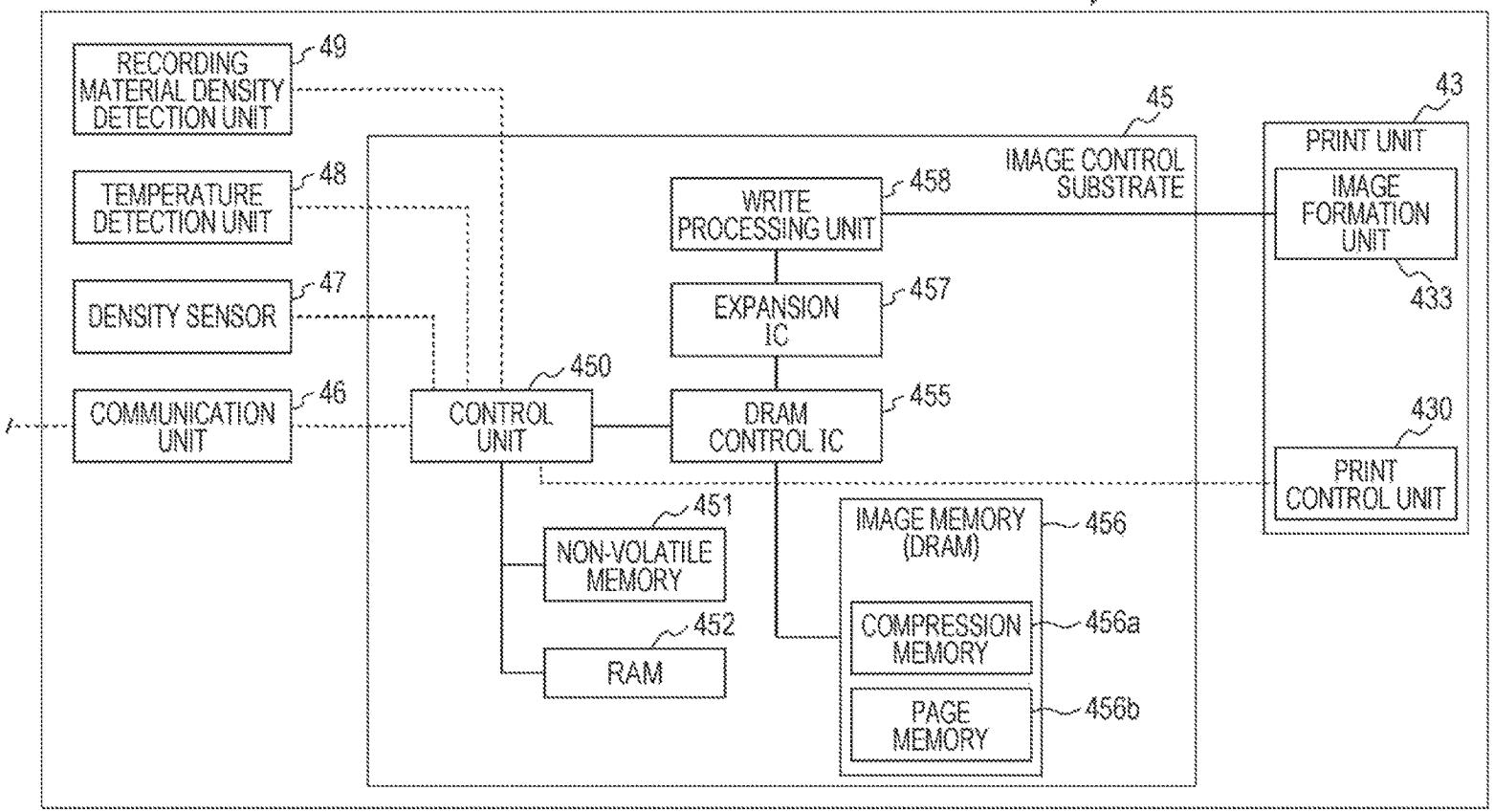
FIG. 3 is a block diagram of an internal configuration of a second image formation apparatus in the image formation system according to the embodiment.

FIG. 3 is a block diagram of an internal configuration of the second image formation apparatus 40 in the image formation system 1 according to the embodiment. As illustrated in FIG. 3, the second image formation apparatus 40 includes a print unit 43, an image control substrate 45, a communication unit 46, a density sensor 47 (corresponding to a second density detection unit in the present invention), a temperature detection unit 48 (corresponding to a second temperature detection unit in the present invention), a recording material density detection unit 49 (corresponding to a second recording material density detection unit in the present invention), and others.

The print unit 43 includes a print control unit 430 and an image formation unit 433 corresponding to the print control unit 230 and the image formation unit 233 of the print unit 23 of the first image formation apparatus 20. The print control unit 430 and the image formation unit 433 are configured in the same manner as the print control unit 230 and the image formation unit 233 of the print unit 23 of the first image formation apparatus 20, and explanations thereof will be omitted.

The image control substrate 45 includes a control unit 450, a non-volatile memory 451, a RAM 452, a DRAM control IC 455, an image memory 456, an expansion IC 457, a write processing unit 458, and others.

The control unit 450 is composed of a CPU and the like, and reads a specified one of a system program and various application programs stored in the non-volatile memory 451, and develops the same in the RAM 452. Then, the control unit 450 executes various processing operations and controls intensively the respective components of the second image formation apparatus 40 and the intermediate apparatus 30 in conjunction with the program developed in the RAM 452.

The non-volatile memory 451 stores various processing programs, various data, and others related to image formation. The non-volatile memory 451 also stores information on the kinds of paper sheets housed in the paper feed trays included in the paper feed apparatus 10, the paper feed unit of the second image formation apparatus 40, and the paper feed unit of the first image formation apparatus 20.

The RAM 452 forms a work area that stores temporarily various programs executed by the control unit 450 and various kinds of data related to the programs. The RAM 452 stores temporarily the data input from the first image formation apparatus 20 via the communication unit 46.

The DRAM control IC 455 controls expansion of compressed image data by the expansion IC 457 and controls input and output of image data into and from the image memory 456, according to an instruction from the control unit 450.

For example, upon receipt of job data and compressed image data from the communication unit 46, the DRAM control IC 455 stores the job data in the RAM 452 and stores the compressed image data in a compression memory 456*a* of the image memory 456. In addition, upon receipt of an instruction for outputting print of the compressed image data stored in the compression memory 456*a* from the control unit 450, the DRAM control IC 455 reads the compressed image data from the compression memory 456*a*, causes the expansion IC 457 to expand the read image data, and stores the same in a page memory 456*b*. Further, upon receipt of an instruction for outputting print of the image data stored in the page memory 456*b*, the DRAM control IC 455 reads the image data from the page memory 456*b* and outputs the same to the write processing unit 458.

The image memory 456 includes the compression memory 456*a* and the page memory 456*b* composed of DRAMs. The compression memory 456*a* is a memory for storing the compressed image data. The page memory 456*b* is a memory for storing temporarily the image data for print output.

The expansion IC 457 expands the compressed image data.

The write processing unit 458 generates print image data for image formation based on the image data input from the DRAM control IC 455, and outputs the same to the print unit 43.

The communication unit 46 is a communication interface for connection to a network to which the respective apparatuses constituting the image formation system 1 are connected. For example, the communication unit 46 performs communications with the first image formation apparatus 20 using a NIC or the like, and performs serial communications with the intermediate apparatus 30 and the post-processing apparatus 50.

The density sensor 47 detects the density of a toner image (image density) formed on a photoconductive drum (second image carrier). The density sensor 47 has a light emission unit that emits light to the photoconductive drum and a light reception unit that receives reflection light from the photoconductive drum based on the emitted light, and supplies the detected density information to the control unit 450. The control unit 450 sets a second density control value as a set value of a parameter for use in density control of the toner image formed on the photoconductive drum. When supplied with the density information from the density sensor 47, the control unit 450 performs a density correction control to change the second density control value based on the density information of the density sensor 47, as the control unit 250 of the first image formation apparatus 20.

The temperature detection unit 48 is arranged near the photoconductive drum and detects the in-machine temperature (corresponding to "second temperature" in the present invention) of the second image formation apparatus 40. The temperature detection unit 48 outputs the detected in-machine temperature to the control unit 450. The control unit 450 sends information on the in-machine temperature from the temperature detection unit 48 to the control unit 250 via the communication unit 26. The control unit 250 acquires the in-machine temperature from the temperature detection unit 48 for each print or at a specific cycle (for example, each five minutes).

The control unit 250 stores the acquired in-machine temperatures in the RAM 252. To store the in-machine temperature in the RAM 252, when no in-machine temperature is previously stored in the RAM 252, the control unit 250 stores the in-machine temperature as in-machine temperature T2, and when any in-machine temperature is already stored in the RAM 252, the control unit 250 stores the in-machine temperature as in-machine temperature T2'. In addition, the control unit 250 calculates a change amount Δ2 (=T2'−T2) of in-machine temperature based on the in-machine temperatures T2 and T2'.

As descried above, when the difference Δ between the change amounts Δ1 and Δ2 exceeds a predetermined threshold, the control unit 250 performs the density correction control such that the density of the toner image detected by the recording material density detection unit 29 and the density of the toner image detected by the recording material density detection unit 49 are equal (no density difference occurs). The threshold is set based on the empirically determined correlative relationship between the difference Δ between the change amounts Δ1 and Δ2 and the density difference. By setting the threshold in this manner, it is possible to suppress productivity decline with a minimum number of times the density correction control is performed, and correct density reduction in the toner image due to temperature rise.

When performing the density correction control, the control unit 250 replaces the value of the in-machine temperature T2 with the value of the in-machine temperature T2', and erases the in-machine temperature T2' from the RAM 252. That is, after the replacement of the values of the in-machine temperatures T1 and T2 (after the density correction control), when the difference Δ between the change amounts Δ1 and Δ2 exceeds again the predetermined threshold, the control unit 250 performs the density correction control.

The recording material density detection unit 49 measures the density of the toner image transferred (output) from the image formation unit 433 to the paper sheet. The recording material density detection unit 49 can be provided in any place of the tandem machine, as the recording material density detection unit 29. The place of the recording material density detection unit 29 may not be necessarily in the second image formation apparatus 40 but may be in the post-processing apparatus 50, for example. The recording material density detection unit 49 is basically configured in the same manner as the recording material density detection unit 29 described above, and descriptions thereof will be omitted. The density correction control based on the density of the toner image measured by the recording material density detection unit 49 will be explained below. The recording material density detection unit 49 may measure the density of a toner patch image, and the density correction control may be performed based on the density of the toner patch image measured by the recording material density detection unit 49.

At the start-up of the system and at the execution of the density correction control, the recording material density detection unit 49 outputs information on the detected density of the toner image to the control unit 450. The control unit 450 sends the information to the control unit 250 via the communication units 26 and 46. The control unit 250 stores in the RAM 252 the density of the toner image via the communication units 26 and 46. When the post-processing apparatus 50 is provided with one density detection unit having the both functions of the recording material density detection units 29 and 49 described above, the density of the toner image detected by the recording material density detection unit 49 is sent from the control unit 450 to the control unit 250 via the communication units 26 and 46.

Figure 4:
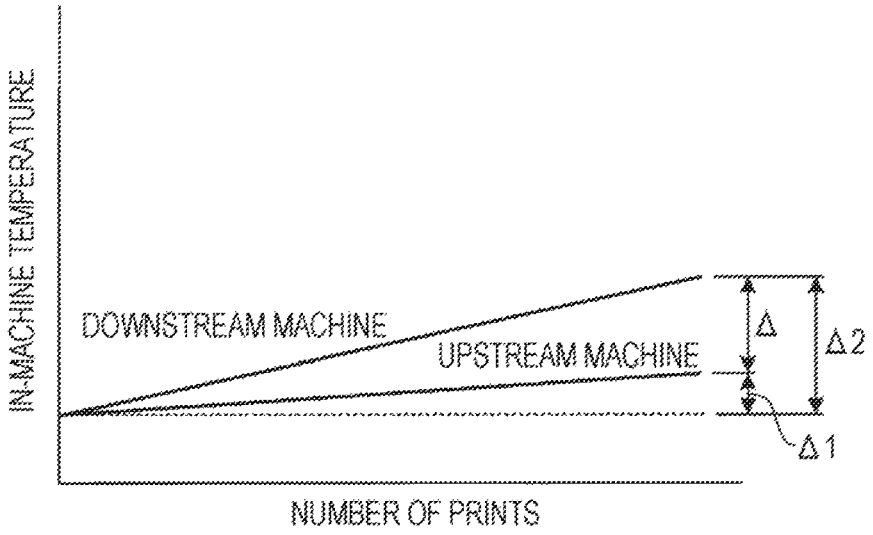
FIG. 4 is a diagram illustrating the relationship between the number of prints and the in-machine temperature.
Figure 5:
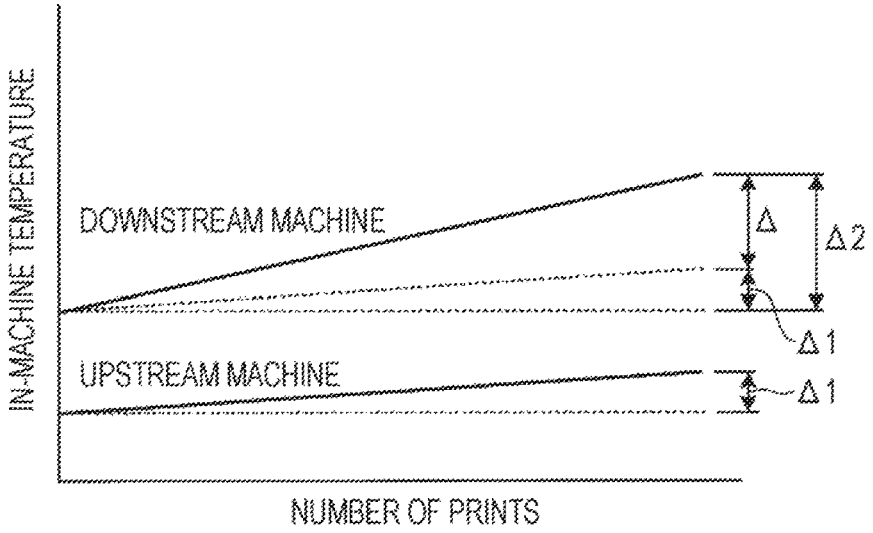
FIG. 5 is a diagram illustrating the relationship between the number of prints and the in-machine temperature.

FIG. 4 illustrates the state in which the equal in-machine temperatures of the upstream machine and the downstream machine at the start-up of the system are rising afterwards at respective gradients depending on the number of prints. In addition, FIG. 5 illustrates the state in which the different in-machine temperatures of the upstream machine and the downstream machine after the start-up of the system are rising afterwards at respective gradients depending on the number of prints. It can be seen from FIGS. 4 and 5 that the difference Δ between the change amounts Δ1 of the in-machine temperature of the upstream machine and the change amounts Δ2 of the in-machine temperature of the downstream machine becomes larger in proportion to the number of prints.

At the time of start-up of the system, for example, the control unit 250 performs the density correction control to change at least one of the first density control value and the second density control value such that the density of the toner image detected by the recording material density detection unit 29 and the density of the toner image detected by the recording material density detection unit 49 become equal. In addition, after the start-up of the system, when the difference Δ between the change amounts Δ1 and Δ2 exceeds the predetermined threshold, the control unit 250 performs the density correction control after the suspension of the print job or the end of the print job. The timing for executing the density correction control may be selectable depending on the size of the print job or the like such that the density correction control is performed after the suspension of the print job with a large number of continuous prints, and the density correction control is performed after the end of the print job with a small number of continuous prints.

[Density Correction Control at the Time of Start]

Figure 6:
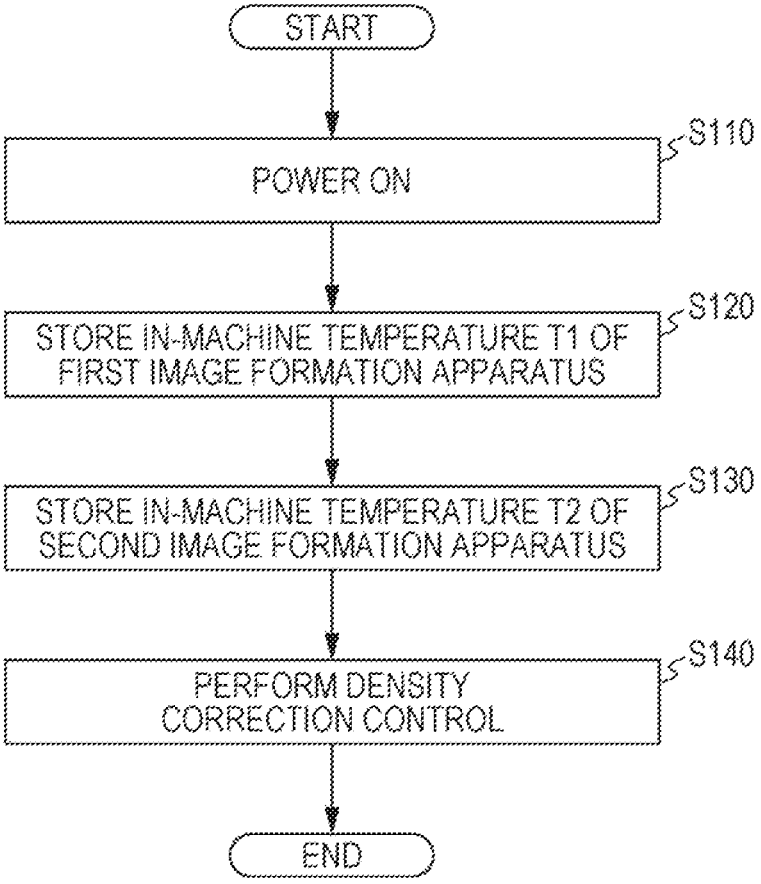
FIG. 6 is a flowchart of a process for density correction control at the start-up of the system.

FIG. 6 is a flowchart of a process for density correction control at the start-up of the system.

As illustrated in FIG. 6, at step S110, the control unit 250 moves to step S120 upon power-on.

At step S120, the control unit 250 stores the in-machine temperature T1 of the first image formation apparatus 20 detected by the temperature detection unit 28 in the RAM 252.

At step S130, the control unit 250 stores the in-machine temperature T2 of the second image formation apparatus 40 detected by the temperature detection unit 48 in the RAM 252.

At step S140, the control unit 250 performs the density correction control.

In the density correction control, the first image formation apparatus 20 outputs a first toner image for maximum density correction. The density sensor 27 detects the density of the first toner image formed on the photoconductive drum. The recording material density detection unit 29 detects the density of the first toner image output to the paper sheet.

The second image formation apparatus 40 outputs a second toner image for maximum density correction to the paper sheet to which the first toner image has been output. The density sensor 47 detects the density of the second toner image formed on the photoconductive drum. The recording material density detection unit 49 detects the density of the second toner image output to the paper sheet.

The control unit 250 performs the density correction control to change at least one of the first density control value and the second density control value such that the value of the density of the first toner image detected by the recording material density detection unit 29 and the value of the density of the second toner image detected by the recording material density detection unit 49 become equal.

The density control value includes one or more of the set value of a development bias potential, the set value of a charge potential of the photoconductive drum, the set values of exposure intensity to the photoconductive drum (the exposure intensity for electrostatic latent writing, the exposure intensity for the neutralization side, and the like), and the set value of ratio between the circumferential velocity of the photoconductive drum and the circumferential velocity of a development roller rotating in opposition to the photoconductive drum.

After the density correction control, the control unit 250 causes the recording material density detection unit 29 to detect again the density of the toner image by, causes the recording material density detection unit 49 to detect again the density of the toner image, and determines (re-verifies) whether the value of the density of the toner image detected by the recording material density detection unit 29 and the density of the toner image detected by the recording material density detection unit 49 are equal. When not detecting that the two values are equal, the control unit 250 performs again the density correction control. From the viewpoint of placing importance on productivity, the step of re-verification may be omitted.

In the density correction control at the start-up of the system, the maximum density is corrected based on the density of a toner image for maximum density correction (maximum density correction control), and a halftone density is corrected based on the density of a toner image for halftone density correction (halftone density correction control).

[Maximum Density Correction Control]

In the first image formation apparatus 20, the control unit 250 sets an output control point (see FIG. 9) of the density sensor 27 and changes the first density control value such that the toner image for image density control output to the paper sheet reaches the target density. In the second image formation apparatus 40 as well as the first image formation apparatus 20, the control unit 450 sets an output control point of the density sensor 47 and changes the second density control value based on density information detected by the density sensor 47 such that the toner image for image density control output to the paper sheet reaches the target density.

Specifically, in the maximum density correction control, a toner image is formed on the photoconductive drum and the density of the toner image is detected by the density sensor 27 and the density sensor 47. The maximum density correction control may be performed between images (paper sheets) formed on the photoconductive drum such that a toner patch image for image density control is formed on the photoconductive drum between the images, and the density of the toner patch image is detected by the density sensor 27 and the density sensor 47.

In the maximum density correction control, when determining that the density of the toner image for image density control output to the paper sheet is lower than the target density, the control units 250 and 450 perform a control to increase the set value of ratio of circumferential velocity of the development roller to the circumferential velocity of the photoconductive drum, for example. When determining that the density of the toner image for image density control output to the paper sheet is higher than the target density, the control units 250 and 450 perform a control to decrease the set value of ratio of the circumferential velocity of the development roller to the circumferential velocity of the photoconductive drum, for example.

Alternatively, instead of the high-density correction control to change the set value of ratio of circumferential velocity of the development roller to the circumferential velocity of the photoconductive drum, the maximum density correction control may be performed to change of the set value of the development bias potential or change the set value of the exposure intensity to the photoconductive drum.

[Halftone Density Correction Control]

In the halftone density correction control, the maximum density correction control is performed for each 10 p (p represents the number of prints), and the halftone density correction control is performed for each 100 p between the images not subjected to the maximum density correction control, for example.

In the first image formation apparatus 20 and the second image formation apparatus 40, the halftone density is corrected based on the density of a toner image for halftone density correction formed on the photoconductive drum. The correction of the halftone density is carried out in such a manner that the toner image for halftone density correction is produced on the photoconductive drum, the density of the toner image is detected by the density sensors 27 and 47, and the screen is selected such that the density of the toner image reaches the target density (target density curve).

The control unit 250 and 450 correct the image density by image processing, for example, correction of a gamma curve (so-called γ correction), based on the density information detected by the density sensors 27 and 47. The γ correction is intended to correct the correlative relationship between the gradation vale of the input image and the gradation value of the actual output image.

[Density Correction Control after Start-Up]

Figure 7:
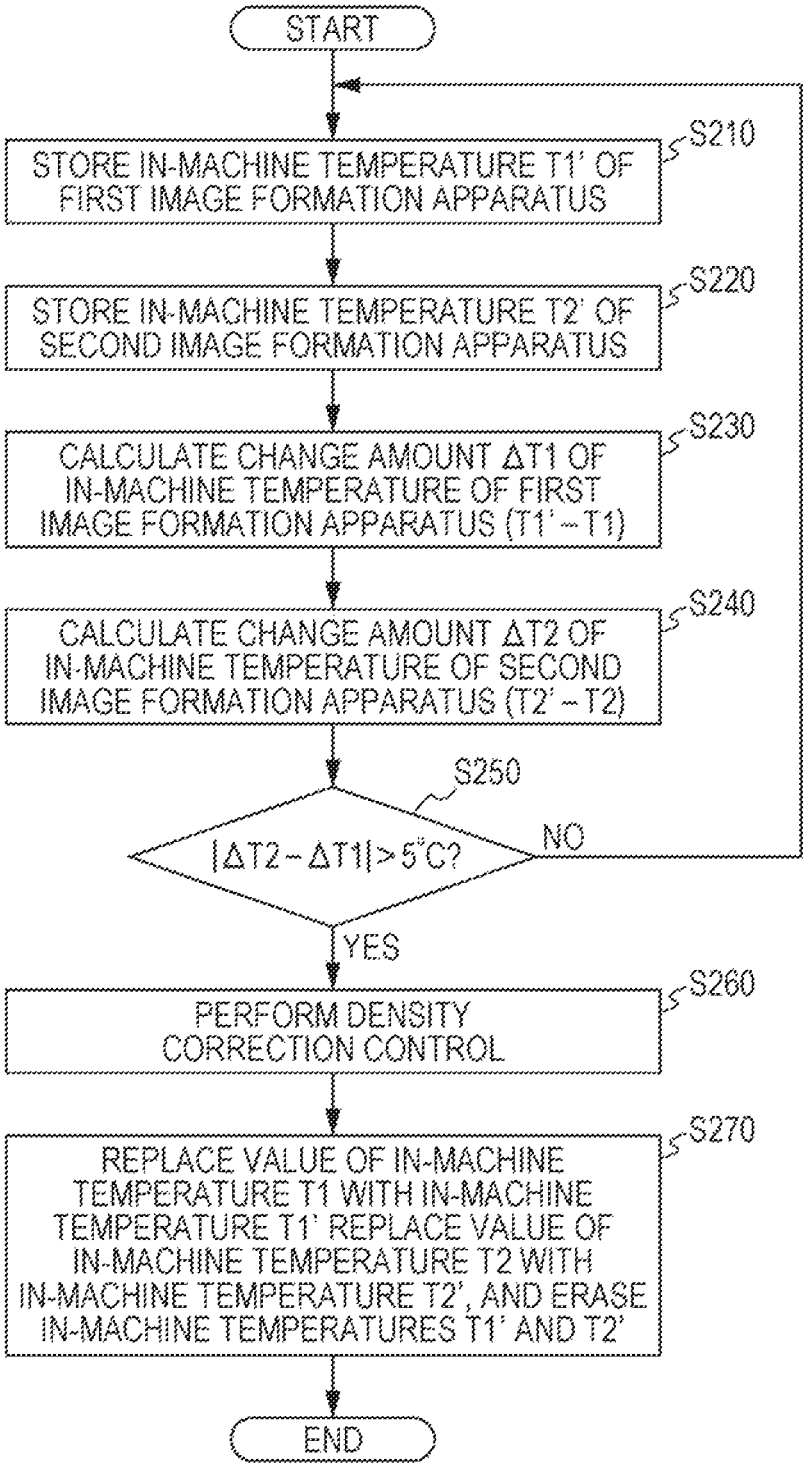
FIG. 7 is a flowchart of a process for density correction control after the start-up of the system.

FIG. 7 is a flowchart of a process for density correction control after the start-up of the system. The following explanation of the flowchart is based on the assumption that, when it is determined that the density correction control is to be executed, the print job is stopped to perform the density correction control.

As illustrated in FIG. 7, at step S210, the control unit 250 stores in the RAM 252 the in-machine temperature T1' of the first image formation apparatus 20 detected by the temperature detection unit 28. When the in-machine temperature T1' is already stored in the RAM 252, the control unit 250 replaces the already stored in-machine temperature T1' with the new in-machine temperature T1'.

At step S220, the control unit 250 stores in the RAM 252 the in-machine temperature T2' of the second image formation apparatus 40 detected by the temperature detection unit 48. When the in-machine temperature T2' is already stored in the RAM 252, the control unit 250 replaces the already stored in-machine temperature T2' with the new in-machine temperature T2'.

At step S230, the control unit 250 calculates the change amount ΔT1 of the in-machine temperature of the first image formation apparatus 20 (T1'−T1).

At step S240, the control unit 250 calculates the change amount ΔT2 of the in-machine temperature of the second image formation apparatus 40 (T2'−T2).

At step S250, the control unit 250 calculates the difference between the change amount ΔT1 and the change amount ΔT2, and determines whether the absolute value of the calculated difference |ΔT2−ΔT1| exceeds 5° C.

When determining that the calculated difference exceeds 5° C. (S250: YES), the control unit 250 moves to step S260. When determining that the calculated difference is equal to or smaller than 5° C. (S250: NO), the control unit 250 moves to step S210.

At step S260, the control unit 250 performs the density correction control. The density correction control is basically identical to the density correction control (described above) at the start-up of the system, and descriptions thereof will be omitted.

At step S270, the control unit 250 replaces the value of the in-machine temperature T1 with the value of the in-machine temperature T1', and erases the in-machine temperature T1' from the RAM 252. The control unit 250 also replaces the value of the in-machine temperature T2 with the value of the in-machine temperature T2', and erases the in-machine temperature T2' from the RAM 252. After that, the control unit 250 terminates the process.

The verification of effectiveness of the image formation system 1 (tandem machine) according to the embodiments will be explained below.

As the tandem machine, a modification of Konicaminolta bhPro2250 was used. The process for image formation on the front and back surfaces of paper sheets was shared between the upstream machine and the downstream machine of the tandem machine to output A4-sized double-side images on the paper sheets. The difference in in-machine temperature was calculated at each feeding of a predetermined number of paper sheets.

The paper sheets for outputting the double-sided images were plain paper sheets. The threshold for the density correction control was set to 5° C. In the embodiment of the present invention, the recording material for outputting the double-sided images were paper sheets. However, the recording material is not limited to paper sheets. For example, the recording material may be resin film sheets. The recording material may be any recording medium that can be conveyed and on which toner images can be formed in the embodiment of the present invention.

At power-on, the in-machine temperatures of the upstream machine and downstream machine were both 23° C. Then, the first density correction control was performed. At that time, a toner image for maximum density control was output to the both sides (front and back sides) of the first paper sheet, and the densities of the image were measured by a reflection densitometer.

TABLE 1

Density transition (plain paper)

| | | Start | 5000 | 10000 | After density correction control |
|---|---|---|---|---|---|
| Upstream machine | Temperature (° C.) | 23 | 25 | 26 | 26 |
| | Density | 1.55 | 1.54 | 1.53 | 1.55 |
| Downstream machine | Temperature (° C.) | 23 | 28 | 32 | 32 |
| | Density | 1.55 | 1.51 | 1.48 | 1.55 |
| Density difference | | 0 | 0.03 | 0.05 | 0 |

Table 1 shows measured densities (reflection densities).

The density difference between the front and back sides was calculated. As shown in Table 1, the density difference between the front and back sides was 0 (=1.55−1.55). The output control point of the density sensor was set such that, at power-on, the amount of toner adhered to the photoconductive drum was 5.0 g/m$^2$ in both the upstream machine and the downstream machine.

After that, when 5000 paper sheets were passed, the in-machine temperature rose to 25° C. in the upstream machine, and rose to 28° C. in the downstream machine. The change amount of in-machine temperature was 2° C. (=25° C.−23° C.) in the upstream machine, and 5° C. (=28° C.−23° C.) in the downstream machine. The difference in the change amount of in-machine temperature was 3° C. (=5° C.−2° C.), but no density correction control was performed. The toner image for maximum density control was output to the 5000th paper sheet, and the densities of the image were measured by the reflection densitometer. The difference in density between the front and back sides was 0.03 (=1.54−1.51) with no problem. Accordingly, productivity decline could be suppressed by not performing unnecessary density correction control.

After that, when 10000 paper sheets were passed, the in-machine temperature rose to 26° C. in the upstream machine, and rose to 32° C. in the downstream machine. The change amount of in-machine temperature was 3° C. (=26° C.−23° C.) in the upstream machine and 9° C. (=32° C.−23° C.) in the downstream machine. When the difference in change amount of in-machine temperature become 6° C. (=9° C.−3° C.), the second density correction control was carried out. The toner image for maximum density control was output to the 10000th paper sheet, and the densities of the image were measured by the reflection densitometer.

Figure 8:
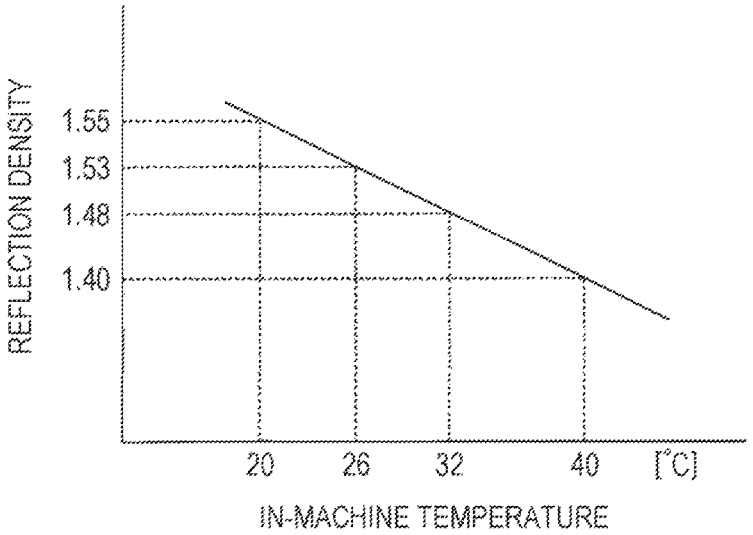
FIG. 8 is a diagram illustrating the relationship between the in-machine temperature and the reflection density.

As shown in Table 1, when the difference in change amount of in-machine temperature become 6° C., the difference in density between the front and back sides was 0.05 (=1.53−1.48) (refer to the drawing of the relationship between the in-machine temperature and the reflection density in FIG. 8).

Figure 9:
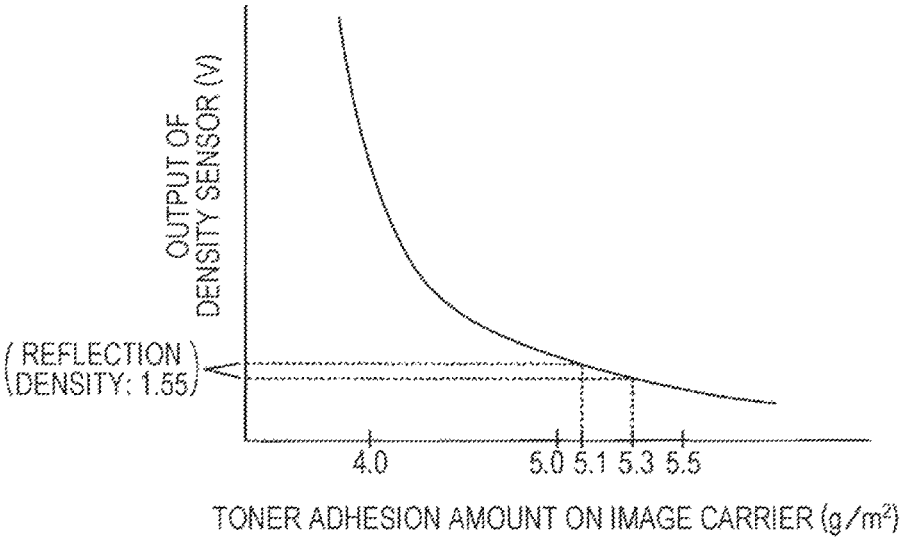
FIG. 9 is a diagram illustrating the relationship between the amount of toner adhesion to an image carrier and sensor output.

The output control point of the density sensor was set such that, after the passage of 10000 paper sheets, the toner adhesion amount was 5.1 g/m$^2$ in the upstream machine and 5.3 g/m$^2$ in the downstream machine and the densities on the front and back sides were both 1.55 (see FIG. 9). Accordingly, increase in the difference in density between the front and back sides could be suppressed by performing the second density correction control.

In addition, when 20000 paper sheets were further passed, the in-machine temperature rose to 27° C. in the upstream machine, and rose to 39° C. in the downstream machine. The change amount of in-machine temperature from the execution of the previous density correction control was 1° C. (=27° C.−26° C.) in the upstream machine and 7° C. (=39° C.−32° C.) in the downstream machine. When the difference in change amount become 6° C., the third density correction control was carried out.

According to the image formation system of the embodiment, when the difference in change amount of in-machine temperature between the upstream machine and the downstream machine exceeds a predetermined threshold, the control unit 250 changes the first and second density control values and performs the density correction control such that the density of the toner image detected by the recording material density detection unit 29 and the density of the toner image detected by the recording material density detection unit 49 are equal. Accordingly, it is possible to correct reduction in the density of the toner image due to temperature rise, and suppress productivity decline by decreasing the number of times the density correction control is performed as much as possible.

In the foregoing embodiment, the density correction control (productivity-oriented control) may be carried out when the difference in change amount of in-machine temperature between the upstream machine and the downstream machine exceeds a predetermined threshold, and the density correction control (image quality-oriented control) may be carried out when the change amount of in-machine temperature detected by the temperature detection unit 28 exceeds a permissible value or when the change amount of in-machine temperature detected by the temperature detection unit 48 exceeds a permissible value. Alternatively, one of the productivity-oriented control and the image quality-oriented control may be selected. This allows the user to select the control taking into account the contents of the job and productivity.

Further, in the foregoing embodiment, the density correction control (productivity-oriented control) may be carried out when the difference in change amount of in-machine temperature between the upstream machine and the downstream machine exceeds a predetermined threshold, and the density correction control (image quality-oriented control) may be carried out when the density of the toner image measured by the recording material density detection unit 29 exceeds a permissible value or when the density of the toner image measured by the recording material density detection unit 49 exceeds a permissible value. Alternatively, one of the productivity-oriented control and the image quality-oriented control may be selected.

In addition, in the foregoing embodiment, the density correction control is carried out both on the image formation apparatuses 20 and 40. However, when the change amount of in-machine temperature in one of the image formation apparatuses is very large and the change amount of in-machine temperature in the other image formation apparatus is very small, for example, the density correction control may be carried out only on the one image formation apparatus with a very large change amount of in-machine temperature.

Further, at execution of the density correction control, both the maximum density correction control and the halftone density correction control are carried out. However, the present invention is not limited to this. For example, when the difference in change amount of in-machine temperature between the upstream machine and the downstream machine is small, the halftone density correction control may not be carried out but the maximum density correction control may be carried out. This makes it possible to shorten the time taken for execution of the density correction control and suppress productivity decline. Further, the user may be allowed to select by the operation display unit 22 between taking priority on productivity by performing the maximum density correction control and taking priority on image quality by performing the maximum density correction control and the halftone density correction control, for example.

In addition, the density correction control is performed in the tandem machine in which the process for image formation on the front and back sides of paper sheets is shared between the upstream machine and the downstream machine to prevent increase in the density difference between the front and back sides. However, the present invention is not limited to this. For example, the density correction control can be performed even in the tandem machine in which the process for image formation in two regions on a single side is shared between the upstream machine and the downstream machine to prevent increase in density difference between the images.

The first density correction control is carried out at start-up of the system (power-on). However, the timing for the first density correction control is not limited to this. Even after the start-up of the system, the first density correction control may be carried out at a timing after the end of one job or after the end of a predetermined number of prints.

The density difference between the front and back sides of text documents is hardly prominent, and a threshold at which the density correction control is to be carried out may be set depending on the contents of the image formed on paper sheets. The contents of the image may be determined by "text mode," "picture mode," and the like selected by the user with the operation display unit 22, or may be determined from information on printing ratio read by the image formation apparatus. When the printing ratio is equal to or lower than 3%, setting the threshold to 10° C. makes it possible to suppress productivity decline.

Further, the relationship between the change amount of in-machine temperature and the transfer ratio may vary depending on the kind of paper (transfer paper). In this case, the threshold for performing the density correction control may be set according to the kind of paper. The threshold is set to be larger for the paper such as coated paper with a high transfer ratio and a small reduction in transfer ratio relative to the change amount of in-machine temperature, and the threshold value is set to be smaller for the paper such as rough paper with a low transfer ratio and a large reduction in transfer ratio relative to the change amount of in-machine temperature.

In relation to the foregoing embodiment, the density correction control has been explained so far. Aside from this, an image stabilization control and a density adjustment control are carried out to control the amount of toner adhered to the photoconductive drum at and after start-up of the system. The image stabilization control is basically the same as the maximum density correction control of the density correction control. The density adjustment control is basically the same as the halftone density correction control of the density correction control. Accordingly, explanations of these controls will be omitted.

In the foregoing embodiment, the present invention is applied to the image formation system 1. However, the present invention is not limited to this. For example, the present invention may also be applied to an image formation apparatus. This image formation apparatus includes a first image formation unit having the function of the first image formation apparatus 20 and a second image formation unit having the function of the second image formation apparatus 40. Further, the image formation apparatus also includes a control unit that performs an image correction control to change the density control value depending on a change in temperature around the first image formation unit (first temperature) and a change in temperature around the second image formation unit (second temperature), and decides the next timing for the density correction control based on a change in the first temperature and a change in the second temperature since the execution of the density correction control.

Further, in the foregoing embodiment, the density correction control is performed when the difference in change amount of in-machine temperature between the upstream machine and the downstream machine exceeds a predetermined threshold. The present invention is not limited to this. For example, the density correction control may be performed based on the value of comparison between the change amount of in-machine temperature of the downstream machine and the change amount of in-machine temperature of the upstream machine.

Besides, the foregoing embodiment is a mere example for carrying out the present invention, and the technical scope of the present invention should not be limitedly interpreted by these examples. That is, the present invention can be carried out in various manners without deviating from the gist or major features of the present invention.

Modification Example 1

The verification of effectiveness of the tandem machine under conditions different from those in the foregoing embodiment will be explained as modification example 1.

In the modification example 1, the paper for outputting double-side images was coated paper. The threshold for carrying out the density correction control was set to 6.5° C.

The in-machine temperature was 23° C. in both the upstream machine and the downstream machine at power-on. Then, the density correction control was carried out, and the densities of the front and back sides at power-on were measured.

TABLE 2

| Density transition (coated paper) | | | | | |
|---|---|---|---|---|---|
| | | Start | 6000 | 13000 | After density correction control |
| Upstream machine | Temperature (° C.) | 23 | 25 | 27 | 27 |
| | Density | 1.55 | 1.54 | 1.53 | 1.55 |
| Downstream machine | Temperature (° C.) | 23 | 29 | 34 | 34 |
| | Density | 1.55 | 1.51 | 1.48 | 1.55 |
| Density difference | | 0 | 0.03 | 0.05 | 0 |

Table 2 shows the measured densities.

After that, when 6000 sheets were passed, for example, the in-machine temperatures of the upstream machine and the downstream machine were measured. Since the difference in change amount of in-machine temperature was 4° C., no density correction control was carried out. The densities of the front and back sides at that time were measured, and the density difference was calculated. The density difference between the front and back sides was 0.03 (=1.54−1.51) with no problem. Accordingly, productivity decline could be suppressed by not performing unnecessary density correction control.

After that, when 13000 sheets were continuously passed, the in-machine temperature rose to 27° C. in the upstream machine, and rose to 34° C. in the downstream machine. The change amount of in-machine temperature was 4° C. (=27° C.−23° C.) in the upstream machine, and 11° C. (=34° C.−23° C.) in the downstream machine. When the difference in change amount of in-machine temperature become 7° C. (=11° C.−4° C.), the second density correction control was carried out. The densities of the front and back sides of the 13000th sheet were measured by a reflection densitometer.

As shown in Table 2, the density difference between the front and back sides was 0.05 (=1.53−1.48) when the difference in change amount of in-machine temperature become 7° C. Accordingly, the densities of the front and back sides become both 1.55 by performing the second density correction control, thereby making it possible to suppress increase in the density difference between the front and back sides.

Modification Example 2

The verification of effectiveness of the tandem machine under conditions different from those in the foregoing embodiment and the modification example 1 will be explained as modification example 2. The modification example 2 of the embodiment will be explained below.

In the modification example 2, the paper for outputting double-side images was rough paper. In addition, the threshold for carrying out the density correction control was set to 3.5° C.

The in-machine temperature was 23° C. in both the upstream machine and the downstream machine at power-on. Then, the density correction control was carried out, and the densities of the front and back sides at power-on were measured.

TABLE 3

| Density transition (rough paper) | | | | | |
|---|---|---|---|---|---|
| | | Start | 4000 | 8000 | After density correction control |
| Upstream machine | Temperature (° C.) | 23 | 25 | 26 | 26 |
| | Density | 1.55 | 1.54 | 1.53 | 1.55 |
| Downstream machine | Temperature (° C.) | 23 | 27 | 30 | 30 |
| | Density | 1.55 | 1.51 | 1.48 | 1.55 |
| Density difference | | 0 | 0.03 | 0.05 | 0 |

Table 3 shows the measured densities (reflection densities).

After that, when 4000 sheets were passed, for example, the in-machine temperatures of the upstream machine and the downstream machine were measured. Since the difference in change amount of in-machine temperature was 3° C., no density correction control was carried out. The densities of the front and back sides at that time were measured, and the density difference was calculated. The density difference between the front and back sides was 0.03 (=1.54−1.51) with no problem. Accordingly, productivity decline could be suppressed by not performing unnecessary density correction control.

After that, when 8000 sheets were continuously passed, the in-machine temperature rose to 26° C. in the upstream machine, and rose to 30° C. in the downstream machine. The change amount of in-machine temperature was 3° C. (=26° C.−23° C.) in the upstream machine, and 7° C. (=30° C.−23° C.) in the downstream machine. When the difference in change amount of in-machine temperature become 4° C. (=7° C.−3° C.), the second density correction control was carried out. The densities of the front and back sides of the 8000th sheet were measured by a reflection densitometer.

As shown in Table 3, the density difference between the front and back sides was 0.05 (=1.53−1.48) when the difference in change amount of in-machine temperature become 4° C. Accordingly, the densities of the front and back sides become both 1.55 by performing the second density correction control, thereby making it possible to suppress increase in the density difference between the front and back sides.

According to an embodiment of the present invention, the density correction control to change at least one of the first and second density control values based on the results of detection by the recording material density detection unit is performed, and the next execution timing for the density correction control is decided based on a change in the first temperature and a change in the second temperature since the execution of the density correction control. Accordingly, it is possible to correct reduction in the density of the toner image due to temperature rise while suppressing productivity decline.

In addition, according to an embodiment of the present invention, the densities of the toner images formed on the front and back sides of the recording material are detected, and the density correction control is executed based on the result of the detection. Accordingly, it is possible to uniform the densities of the toner images formed on the front and back sides of the recording material.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An image formation system of series tandem type in which first and second image formation apparatuses connected in series execute an image formation process on a recording material, wherein the first image formation apparatus includes:

a first image carrier;

a first toner image formation unit configured to form a first toner image on the first image carrier;

a first density detection unit configured to detect the density of the first toner image that is formed by the first toner image formation unit and is yet to be transferred to the recording material;

a first density control value setting unit configured to set a first density control value that is a set value of a parameter for use in density control of the first toner image based on the result of detection by the first density detection unit; and a first temperature detection unit configured to detect the internal temperature of the first image formation apparatus as first temperature, the second image formation apparatus includes:

a second image carrier;

a second toner image formation unit configured to form a second toner image on the second image carrier;

a second density detection unit configured to detect the density of the second toner image that is formed by the second toner image formation unit and is yet to be transferred to the recording material;

a second density control value setting unit configured to set a second density control value that is a set value of a parameter for use in density control of the second toner image based on the result of detection by the second density detection unit; and a second temperature detection unit configured to detect the internal temperature of the second image formation apparatus as second temperature, and the image formation system comprises:

a recording material density detection unit configured to detect the density of the first toner image or the second toner image formed on the recording material; and a control unit configured to execute a density correction control to change at least one of the first and second density control values based on the result of detection by the recording material density detection unit, and decide the next execution timing for the density correction control based on a change in the first temperature and a change in the second temperature since the execution of the density correction control.

2. The image formation system according to claim 1, wherein the control unit implements a first mode in which the execution timing is decided when the difference between a change amount of the first temperature and a change amount of the second temperature exceeds a threshold.

3. The image formation system according to claim 1, wherein, at execution of the density correction control, records on the first temperature and the second temperature are rewritten and used in determination on the decision of the execution timing.

4. The image formation system according to claim 2, wherein the control unit implements selectively the first mode and a second mode in which, in addition to the implementation of the first mode, when the change amount of the first temperature exceeds a permissible value or when the change amount of the second temperature exceeds a permissible value, the execution timing is decided.

5. The image formation system according to claim 1, wherein the recording material density detection unit includes a first recording material density detection unit configured to detect the density of a toner image formed on one of the both sides of the recording material by the first toner image formation unit, and a second recording material density detection unit configured to detect the density of a toner image formed on the other of the both sides of the recording material by the second toner image formation unit.

6. The image formation system according to claim 2, wherein the threshold is set depending on the contents of the image formed on the recording material.

7. The image formation system according to claim 2, wherein the threshold is set depending on the kind of the recording material.

8. An image density correction method of series tandem type by which first and second image formation apparatuses connected in series execute an image formation process on a recording material, the method comprising:

forming a first toner image on a first image carrier based on a first density control value;

forming a second toner image on a second image carrier based on a second density control value;

detecting the density of a toner image formed on the recording material;

detecting the internal temperature of the first image formation apparatus as first temperature, detecting the internal temperature of the second image formation apparatus as second temperature, and executing a density correction control to change at least one of the first and second density control values based on the result of detection of the densities of the toner images, and deciding the next execution timing for the density correction control based on a change in the first temperature and a change in the second temperature since the execution of the density correction control.

9. The image density correction method according to claim 8, comprising implementing a first mode in which the execution timing is decided when the difference between a change amount of the first temperature and a change amount of the second temperature exceeds a threshold.

10. The image density correction method according to claim 8, wherein, at execution of the density correction control, records on the first temperature and the second temperature are rewritten and used in determination on the decision of the execution timing.

11. The image density correction method according to claim 9, comprising implementing selectively the first mode and a second mode in which, in addition to the implementation of the first mode, when the change amount of the first temperature exceeds a permissible value or when the change amount of the second temperature exceeds a permissible value, the execution timing is decided.

12. The image density correction method according to claim 8, wherein, for detecting the density of the toner image, first recording material density detection is executed to detect the density of a toner image formed on one of the both sides of the recording material by the first toner image formation unit and second recording material density detection is executed to detect the density of a toner image formed on the other of the both sides of the recording material by the second toner image formation unit.

13. The image density correction method according to claim 9, wherein the threshold is set depending on the contents of the image formed on the recording material.

14. The image density correction method according to claim 9, wherein the threshold is set depending on the kind of the recording material.

15. An image formation apparatus in which first and second image formation units connected in series execute an image formation process on a recording material, wherein the first image formation unit includes:

a first image carrier;

a first toner image formation unit configured to form a first toner image on the first image carrier;

a first density detection unit configured to detect the density of the first toner image that is formed by the first toner image formation unit and is yet to be transferred to the recording material;

a first density control value setting unit configured to set a first density control value that is a set value of a parameter for use in density control of the first toner image based on the result of detection by the first density detection unit; and a first temperature detection unit configured to detect the temperature around the first image formation unit as first temperature, the second image formation unit includes:

a second image carrier;

a second toner image formation unit configured to form a second toner image on the second image carrier;

a second density detection unit configured to detect the density of the second toner image that is formed by the second toner image formation unit and is yet to be transferred to the recording material;

a second density control value setting unit configured to set a second density control value that is a set value of a parameter for use in density control of the second toner image based on the result of detection by the second density detection unit; and a second temperature detection unit configured to detect the temperature around the second image formation unit as second temperature, and the image formation apparatus comprises:

a recording material density detection unit configured to detect the density of the first toner image or the second toner image formed on the recording material; and a control unit configured to execute a density correction control to change at least one of the first and second density control values based on the result of detection by the recording material density detection unit, and decide the next execution timing for the density correction control based on a change in the first temperature and a change in the second temperature since the execution of the density correction control.

16. The image formation apparatus according to claim 15, wherein the control unit implements a first mode in which the execution timing is decided when the difference between a change amount of the first temperature and a change amount of the second temperature exceeds a threshold.

17. The image formation apparatus according to claim 15, wherein, at execution of the density correction control, records on the first temperature and the second temperature are rewritten and used in determination on the decision of the execution timing.

18. The image formation apparatus according to claim 16, wherein the control unit implements selectively the first mode and a second mode in which, in addition to the implementation of the first mode, when the change amount of the first temperature exceeds a permissible value or when the change amount of the second temperature exceeds a permissible value, the execution timing is decided.

19. The image formation apparatus according to claim 15, wherein the recording material density detection unit includes a first recording material density detection unit configured to detect the density of a toner image formed on one of the both sides of the recording material by the first toner image formation unit, and a second recording material density detection unit configured to detect the density of a toner image formed on the other of the both sides of the recording material by the second toner image formation unit.

20. The image formation apparatus according to claim 16, wherein the threshold is set depending on the contents of the image formed on the recording material.

* * * * *